US007772550B2

(12) United States Patent
Schaefer et al.

(10) Patent No.: US 7,772,550 B2
(45) Date of Patent: Aug. 10, 2010

(54) ELECTRONIC DRIVE AND ACQUISITION SYSTEM FOR MASS SPECTROMETRY

(75) Inventors: Rembrandt Thomas Schaefer, Pasadena, CA (US); Mohammad Mojarradi, La Canada, CA (US); Ara Chutjian, La Crescenta, CA (US); Murray R. Darrach, Valencia, CA (US); John MacAskill, Pasadena, CA (US); Tuan Tran, Upland, CA (US); Gary R. Burke, Moorpark, CA (US); Stojan M. Madzunkov, Monrovia, CA (US); Brent R. Blaes, San Dimas, CA (US); John L. Thomas, Duarte, CA (US); Ryan A. Stern, Los Angeles, CA (US); David Q. Zhu, Pasadena, CA (US)

(73) Assignee: California Institute of Technology, Pasadena, CA (US)

( * ) Notice: Subject to any disclaimer, the term of this patent is extended or adjusted under 35 U.S.C. 154(b) by 609 days.

(21) Appl. No.: 11/800,421

(22) Filed: May 3, 2007

(65) Prior Publication Data

US 2008/0001083 A1 Jan. 3, 2008

Related U.S. Application Data

(60) Provisional application No. 60/797,737, filed on May 3, 2006.

(51) Int. Cl.
*H01J 49/26* (2006.01)

(52) U.S. Cl. ..... 250/290; 250/281; 250/282

(58) Field of Classification Search ..... 250/281, 250/282, 290, 291, 292, 293, 294, 295, 297
See application file for complete search history.

(56) References Cited

U.S. PATENT DOCUMENTS

| | | | | |
|---|---|---|---|---|
| 5,206,506 | A * | 4/1993 | Kirchner | 250/281 |
| 7,161,142 | B1 * | 1/2007 | Patterson et al. | 250/281 |
| 2005/0051720 | A1 * | 3/2005 | Knecht et al. | 250/288 |

OTHER PUBLICATIONS

PCT International Search Report and the Written Opinion of the International Searching Authority.
PCT International Preliminary Report on Patentability.

* cited by examiner

*Primary Examiner*—Jack I Berman
*Assistant Examiner*—Nicole Ippolito Rausch
(74) *Attorney, Agent, or Firm*—Tope-McKay & Associates

(57) ABSTRACT

The present invention discloses an mixed signal RF drive electronics board that offers small, low power, reliable, and customizable method for driving and generating mass spectra from a mass spectrometer, and for control of other functions such as electron ionizer, ion focusing, single-ion detection, multi-channel data accumulation and, if desired, front-end interfaces such as pumps, valves, heaters, and columns.

17 Claims, 6 Drawing Sheets

ELECTRONIC DRIVE AND ACQUISITION SYSTEM FOR MASS SPECTROMETRY

CROSS-REFERENCE TO RELATED APPLICATIONS

This application claims the benefit of priority of U.S. Utility Provisional Patent Application No. 60/797,737, filed 3 May 2006, the entire disclosure of which Application is expressly incorporated by reference in its entirety herein.

STATEMENT REGARDING FEDERALLY SPONSORED RESEARCH OR DEVELOPMENT

The invention described herein was made in the performance of work under a NASA contract, and is subject to the provisions of Public Law 96-517 (35 USC 202) in which the Contractor has elected to retain title.

BACKGROUND OF THE INVENTION (1) Field of the Invention

The present invention relates to mass spectrometers and, more particularly, to the electronic drive and acquisition system for a mass spectrometer.

(2) Description of Related Art

Conventional drive systems for mass spectrometers are well known and have been in use for a number of years. Reference is made to the following exemplary U.S. Pat. No. 7,161,142 to Patterson et al., the entire disclosure of which is incorporated herein by reference. Regrettably, most prior art conventional drive systems for mass spectrometers suffer from obvious disadvantages in terms of mass-volume-power of the components and spectral resolution limitations. For example, as illustrated in the prior art FIG. 1, which is also illustrated in FIG. 10 of U.S. Pat. No. 7,161,142 to Patterson et al. (but without annotations), demonstrates a Full Width Half Max (FWHM) mass resolution M/ΔM of 92 AMU/2.25 AMU=40.9, which is a poor mass resolution by commercial standards. This poor resolution severely increases the mass cross talk, which precludes use of such a mass spectrometer for measuring accurate isotope ratios in, for example, nuclear treaty verification and in species age dating. In addition, as illustrated in the FIG. 9 of the same patent, the ramp waveform demonstrates non-linearity at the initial break point, which can lead to further degraded mass resolution near the Low Mass Cut Off (LMCO). Further, most prior art drive systems operate at a single frequency, and must be manually tuned (as disclosed in U.S. Pat. No. 7,161,142 to Patterson et al.).

Further, most components of the prior art mass spectrometer are three to ten times larger than the mass spectrometer sensor itself, and the output waveform developed from the existing drive electronics contains noise and harmonic distortion that continues to contribute to the sensitivity of the mass spectrometer. In particular, air-core transformers used in commercial systems to boost the amplitude of the mass spectrometer's RF driving voltage are one of the more bulky system components. The air-core transformers are part of an all-analog system that, when coupled to a high-Q inductor-capacitor resonance circuit, affords stable, high-amplitude RF voltage.

Accordingly, in light of the current state of the art and the drawbacks to current drive systems for mass spectrometers mentioned above, a need exists for an integral, miniaturized electronic drive and acquisition system for mass spectrometers that would have a small form factor in terms of mass and volume, and that would provide accurate, adjustable current and voltage drive and would further include an integral acquisition unit for acquiring and collecting final mass data in sync with the drive system. In addition, a need exists for an integral, miniaturized electronic drive and acquisition system for mass spectrometers that would exhibit highly stable and linear waveforms that would dramatically increase mass spectral resolution, and provide automatic self-tuning.

BRIEF SUMMARY OF THE INVENTION

The present invention discloses a closed loop control of a mass spectrometer through a series resonant drive coupled with a synchronous data acquisition system.

In particular, one aspect of the present invention provides an electronic drive system for signal generation, comprising a mixed signal RF drive electronics board. The mixed signal RF drive electronics board includes a control unit for generating a digital signal used for driving a mass spectrometer, and a Digital to Analog Converter (DAC) coupled with the control unit for converting the digital signal to an analog signal. The mixed signal RF drive electronics board further includes an Analog Multiplying Cell (AMC) coupled with the DAC for scaling a final output signal amplitude based on a desired mass scanning range, and a Radio Frequency Power Amplifier (RF PA) coupled with the AMC for driving the final output signal. The mixed signal RF drive electronics board further includes an inductive element coupled with the RF PA and the mass spectrometer for amplification of the final output signal at a resonant frequency of the inductive element and a capacitance presented by the mass spectrometer. Further included with the mixed signal RF drive electronics board is a closed loop feedback unit coupled with the control unit for continuous fine-tuning of the final output signal for accommodating environmental variation and system non-linearities. The mixed signal RF drive electronics board also includes an acquisition unit for acquiring and collecting mass spectral data from mass spectrometer.

An optional aspect of the present invention provides an electronic drive system for signal generation with the control unit is clocked by an oscillator driven.

Another optional aspect of the present invention provides an electronic drive system for signal generation with the oscillator being a temperature compensated crystal oscillator.

Yet another optional aspect of the present invention provides an electronic drive system for signal generation, wherein the control unit is comprised of a Field Programmable Gate Array (FPGA).

Still another optional aspect of the present invention provides an electronic drive system for signal generation with the FPGA including front-end logic, which has a serial interface that allows for communication from the FPGA to a host computing device, and a command interface that processes serial commands. Further included with the front-end logic of the FPGA is a register interface for register setting and management, and a channel counter for counting pulses from a pre-amplifier and discriminator unit and continuously double buffering an accumulated mass spectrum into a Random Access Memory (RAM). The serial, command, and register interfaces and the channel counter are all in communicate with one another so that control unit can communicate with the host system.

A further optional aspect of the present invention provides an electronic drive system for signal generation, wherein an accumulation of an acquired mass spectrum is performed in a multi-channel scaling mode where successive time bins are summed in a correct location, with double buffering required so that real-time counting continues while transmission of a previous frame is carried out.

Yet a further optional aspect of the present invention provides an electronic drive system for signal generation with the FPGA including a Direct Digital Synthesis (DDS) sine generator module for generating a fixed amplitude digital sine wave.

Still a further optional aspect of the present invention provides an electronic drive system for signal generation, wherein the digital sine wave is digitally modulated with a ramp envelope signal through a use of an embedded multiplier.

Another optional aspect of the present invention provides an electronic drive system for signal generation, wherein the FPGA includes a calibrator module for determining an optimum operational frequency for the drive current.

Yet another optional aspect of the present invention provides an electronic drive system for signal generation with the calibrator module enacted when initiated and functions prior to each operational run.

Still another optional aspect of the present invention provides an electronic drive system for signal generation, wherein the optimum operational frequency is at the resonant frequency of the inductive element and the capacitance represented by the mass spectrometer.

A further optional aspect of the present invention provides an electronic drive system for signal generation, wherein the resonant frequency is determined by sequentially sweeping, and iteratively reducing an initial upper and lower bound frequency instantiated by the feedback unit into a granularity of finer resolution frequency. Each iterative frequency sweep has a span that is less than a span of a previous sweep with the upper and lower bound frequency one-half spectrum as a previous sweep. A center of each subsequent frequency sweep is located where a peak signal from the feedback unit was found. In a final iterative stages of calibration, as a resonant peak is located, the calibrator module is switched into a Q-mode where a sweep is performed to determine several consistent peak values found, and a single center frequency is returned by finding symmetrical deviations from the peak value and finding the mid-point of the deviations.

Yet a further optional aspect of the present invention provides an electronic drive system for signal generation, with the FPGA including a ramp sequencer for generating a correct number of ramps, and providing any required delays by a time period between generated ramps.

Still a further optional aspect of the present invention provides an electronic drive system for signal generation, wherein the FPGA ramp sequencer further functions to place the FPGA in a continuous operational mode.

Another optional aspect of the present invention provides an electronic drive system for signal generation, wherein the FPGA includes a ramp generator for generating linear ramp outputs of a particular slope and initial and final amplitude, forming an envelope signal, which is determined based on a mass range scanned.

Yet another optional aspect of the present invention provides an electronic drive system for signal generation, with the FPGA including a Gain Digital to Analog Converter Serial Peripheral Interface (Gain DAC SPI) module that receives a digital value that sets a scale factor for a mass range scanned that is used by a Gain Digital to Analog Converter (Gain DAC).

Still another optional aspect of the present invention provides an electronic drive system for signal generation, wherein the FPGA includes a Proportional Integral Derivative (PID) control module for amplitude stabilization of a high voltage RF output on a ramp to ramp basis.

A further optional aspect of the present invention provides an electronic drive system for signal generation with the FPGA including an Analog to Digital Converter Serial Peripheral Interface (ADC SPI) module for communication with an external Analog to Digital Converter (ADC).

Yet a further optional aspect of the present invention provides an electronic drive system for signal generation, wherein the FPGA includes an Analog to Digital Converter Averager (ADC Avg) that acquires $2^n$ samples from the ADC SPI module and averages them; with n determined by a register setting.

Still a further optional aspect of the present invention provides an electronic drive system for signal generation with the FPGA including a Pulse Amplitude Discriminator Digital to Analog Converter Serial Peripheral Interface (PAD DAC SPI) for setting the PAD DAC, which sets a threshold for the PAD.

Another optional aspect of the present invention provides an electronic drive system for signal generation, wherein the FPGA includes a Transistor Transistor Logic (TTL) generator module that generates pulses that are synchronous to certain portions of each ramp such that high voltage pulsing circuitry can be driven to create proper ionization, grid and lens voltages on instrument.

Yet another optional aspect of the present invention provides an electronic drive system for signal generation with the DAC clocked by the control unit that generates a clocked signal using Low Voltage Differential Signal (LVDS).

Still another optional aspect of the present invention provides an electronic drive system for signal generation, wherein the DAC is a high speed digital to analog converter;

A further optional aspect of the present invention provides an electronic drive system for signal generation, wherein the DAC is clocked inverted from the control unit frequency operations for preventing data converter glitches.

Yet a further optional aspect of the present invention provides an electronic drive system for signal generation with a differential buffer coupled with a differential current output DAC for generating a continuous voltage signal.

Still a further optional aspect of the present invention provides an electronic drive system for signal generation, wherein the AMC is comprised of a VGA, with the VGA coupled with a Gain Digital to Analog Converter (Gain DAC), with the digital value of the Gain DAC representing a direct current (DC) voltage of a predetermined value set with a voltage reference $V_{REF}$ coupled with the Gain DAC for providing fixed, stable voltage reference Another optional aspect of the present invention provides an electronic drive system for signal generation with the RF PA comprised of one or more high speed amplifiers coupled in parallel topography for driving a final output signal, which is a high current output drive signal.

Yet another optional aspect of the present invention provides an electronic drive system for signal generation with the inductive element comprised of a number of inductors coupled in series.

Still another optional aspect of the present invention provides an electronic drive system for signal generation, wherein the number of inductors and core material selected is such that AC flux density is limited to a linear regime of the core material's permeability deviations.

A further optional aspect of the present invention provides an electronic drive system for signal generation, wherein the core material is comprised of an iron powdered mix with distributed air gap.

Yet a further optional aspect of the present invention provides an electronic drive system for signal generation, wherein core geometry and winding configuration is selected to operate at an optimal point on an inherent Q curve for the selected core geometry and winding configuration, which minimizes losses to reduce power consumption, increase quality factor and sharpness of bandpass filter created by the series resonant configuration.

Still a further optional aspect of the present invention provides an electronic drive system for signal generation, wherein the series coupled inductors are coupled with the mass spectrometer in a series resonant configuration.

Another optional aspect of the present invention provides an electronic drive system for signal generation, wherein the plurality of inductors are remotely coupled with the RF PA, and are coupled with a flange of a mass spectrometer on a board.

Yet another optional aspect of the present invention provides an electronic drive system for signal generation with the electronic drive unit, the magnetic board, and the PAD unit integrated on a single PCB.

Still another optional aspect of the present invention provides an electronic drive system for signal generation, with the feedback unit comprised of a pair of resistors that form a divider circuit that provides an RF sense signal that is a divided version of a high voltage output, which is fed back to the electronic drive system.

A further optional aspect of the present invention provides an electronic drive system for signal generation, wherein the feedback unit is further comprised of a Field Effect Transistor (FET) input buffer that receives the RF sense signal, and outputs the results to a Root-Mean-Square to Direct converter (RMS-DC), which is sampled by an Analog to Digital Converter for use of the control unit for automatic detection of the resonant RF prior to instrument operation and closed loop RF amplitude control if Proportional Integral Differential (PID) mode is enable.

Yet a further optional aspect of the present invention provides an electronic drive system for signal generation, wherein the initial detection of the resonant frequency is carried out using a state machine that performs successive sweeps of increasing granularity with a bounds programmed by user-defined registers.

Still a further optional aspect of the present invention provides an electronic drive system for signal generation, wherein the mass spectrometer is a Paul Ion Trap mass spectrometer.

Another optional aspect of the present invention provides an electronic drive system for signal generation, wherein the mixed signal RF drive electronics board is comprised of multiple planes including a partitioned ground plane and a use of low noise layout.

These and other features, aspects, and advantages of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention. Throughout the disclosure, the word "exemplary" is used exclusively to mean "serving as an example, instance, or illustration." Any embodiment described as "exemplary" is not necessarily to be construed as preferred or advantageous over other embodiments.

Referring to the drawings in which like reference character(s) present corresponding part(s) throughout.

DETAILED DESCRIPTION OF THE INVENTION

Figure 1:
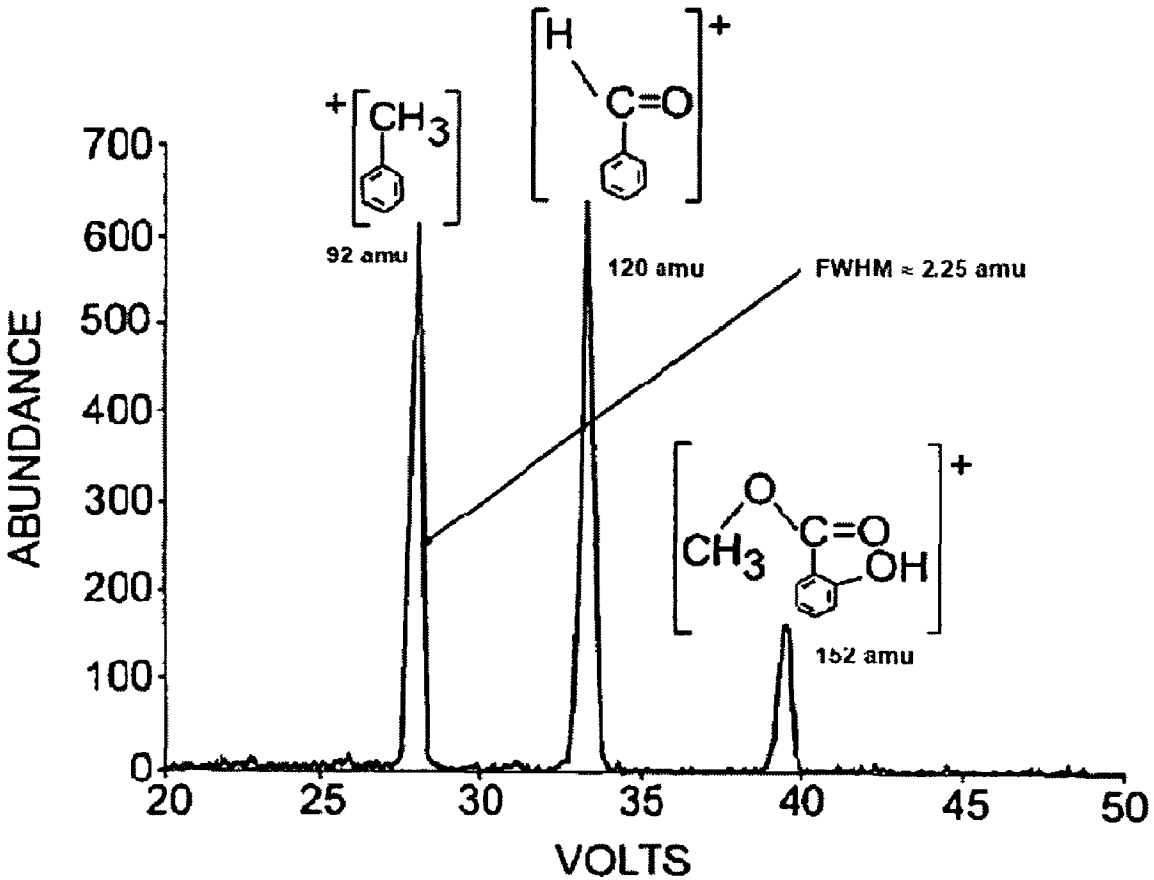
FIG. 1 (Prior Art)
FIG. 1 is a prior art illustration of a mass spectrum of methyl salicylate.

The detailed description set forth below in connection with the appended drawings is intended as a description of presently preferred embodiments of the invention and is not intended to represent the only forms in which the present invention may be constructed and or utilized.

For purposes of illustration, programs and other executable program components are illustrated herein as discrete blocks, although it is recognized that such programs and components may reside at various times in different storage components, and are executed by the data processor(s) of the computers.

Quadrupole mass spectrometers in general and the Paul Ion Trap dynamic mass spectrometer in particular, require an RF waveform applied to the poles, or to the trap ring electrode for operation. This waveform is ramped up linearly and the value of the fixed frequency and low and high voltage amplitudes determine the mass range that will be detected resulting in the generated spectrum. The drive electronics of prior art systems are large transformers, and frequencies in the greater than 1 MHz range, and are not conducive to low power applications or miniaturization.

The present invention provides a novel architecture for direct drive of a mass spectrometer using direct digital synthesis of the final output waveform. The drive system of the present invention includes a control unit in the form of an exemplary Field Programmable Gate Array (FPGA) to set the frequency and ramping amplitudes and synthesize the full waveform digitally. The architecture includes a self-tuning methodology for identifying the resonant frequency of the system. The ability to self-tune to resonance allows automatic frequency adjustment to compensate for load capacitance or inductive element variations (with the mass spectrometer viewed as a capacitive load). This mixed-signal architecture combined with the amplification of signals by means of a series resonant tank circuit allow for a low power solution (<10 W) with further miniaturization from the Printed Circuit Board (PCB) to a system on a chip.

The present invention provides an electronic drive system that directly synthesizes a digital waveform for a mass spectrometer using a control unit. The digital waveform output from the control unit is applied to a Digital to Analog Converter (DAC) that converts the waveform to an analog signal. The analog signal is then multiplied by a gain multiplying cell and applied to a resonant inductor-capacitor (LC) tank, which is comprised of a plurality of inductors and the capacitance of the ring electrode within the ion trap mass spectrometer. Voltage amplification is achieved across the capacitive ring electrode by applying the analog signal at a resonant frequency of the LC tank (forming or constituting a series resonant tank). Frequency stability is addressed by using a numerically controlled oscillator internal to the control unit that is clocked by a temperature controlled oscillator. Therefore, any phase noise observed on the output is only a manifested version of the jitter found on the digital clock after it has been significantly "divided down." The use of a series resonant tank also acts as a high Q (quality factor) bandpass filter removing any quantization noise and maintaining mass resolution in the resulting spectrum. Trap capacitance variations are handled by closed loop measurement and dialing into resonance. To allow the output waveform to run at the resonant frequency a search methodology is used to determine the exact frequency at which the LC tank resonates, which frequency is then used by the control unit.

Figure 2:
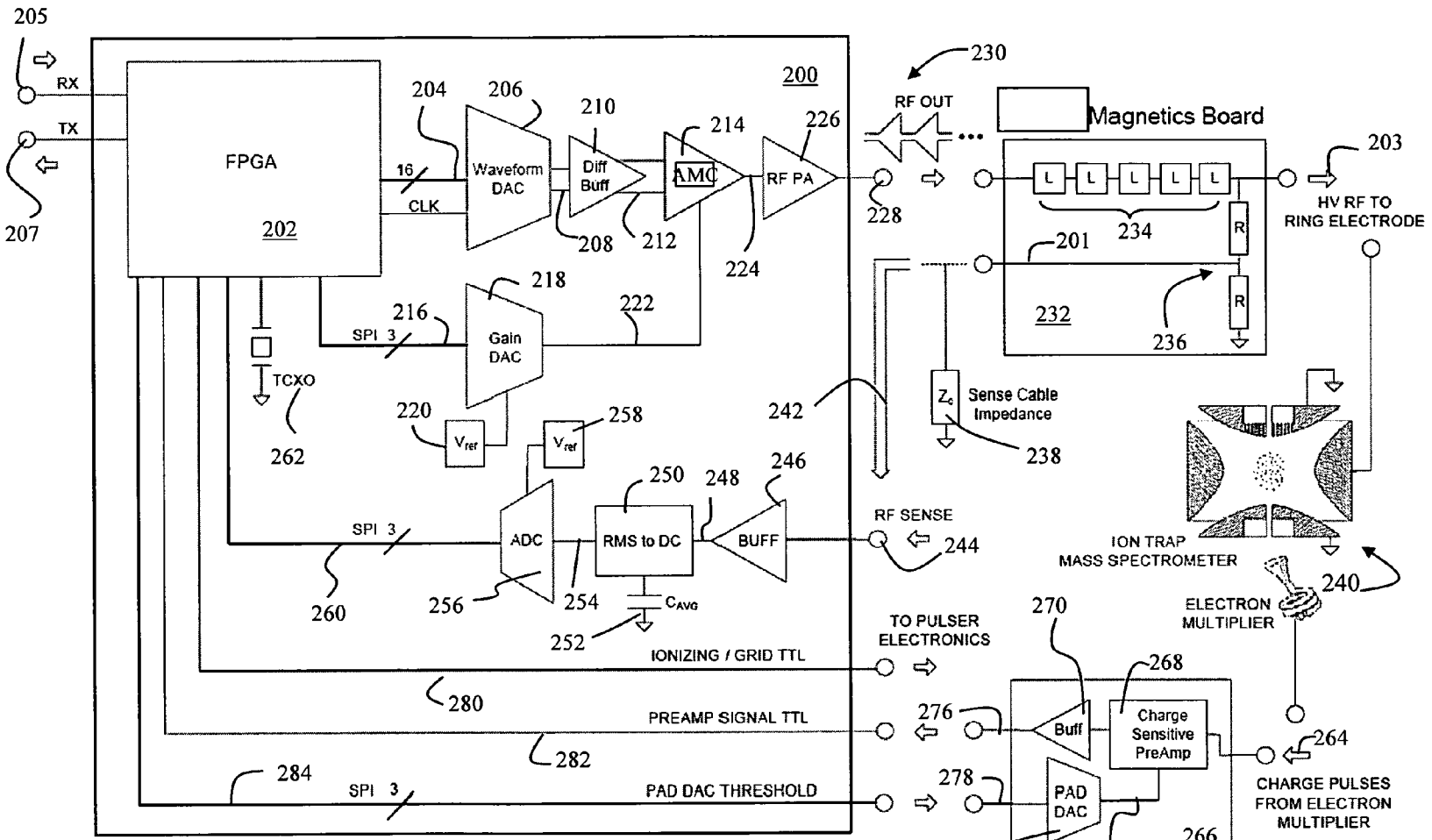
FIG. 2 is an exemplary schematic functional block diagram of an electronic drive and acquisition system for a mass spectrometer in accordance with the present invention.

FIG. 2 is an exemplary schematic functional block diagram of an electronic drive and acquisition system for a mass spectrometer in accordance with the present invention. As illustrated in FIG. 2, the electronic drive and acquisition system is used for generating an RF high voltage signal 203 that drives a mass spectrometer 240. The electronic drive and acquisition system illustrated in FIG. 2 includes a mixed signal RF drive electronics board 200 that is an electronic drive system for an exemplary ion trap mass spectrometer 240. The mixed signal RF drive electronics board 200 includes a control unit 202 in the form of an exemplary Field Programmable Gate Array (FPGA) that generates a digital signal 204 used for driving the mass spectrometer 240. The FPGA 202 is clocked by an oscillator, a non-limiting example of which may include a temperature compensated crystal oscillator 262 that provides one part per million (1 ppm) of stability. The synthesized sine wave is a registered output and clocked a half cycle out of phase (ensuring adequate setup time) to prevent race conditions and converter data glitches.

Figure 3:
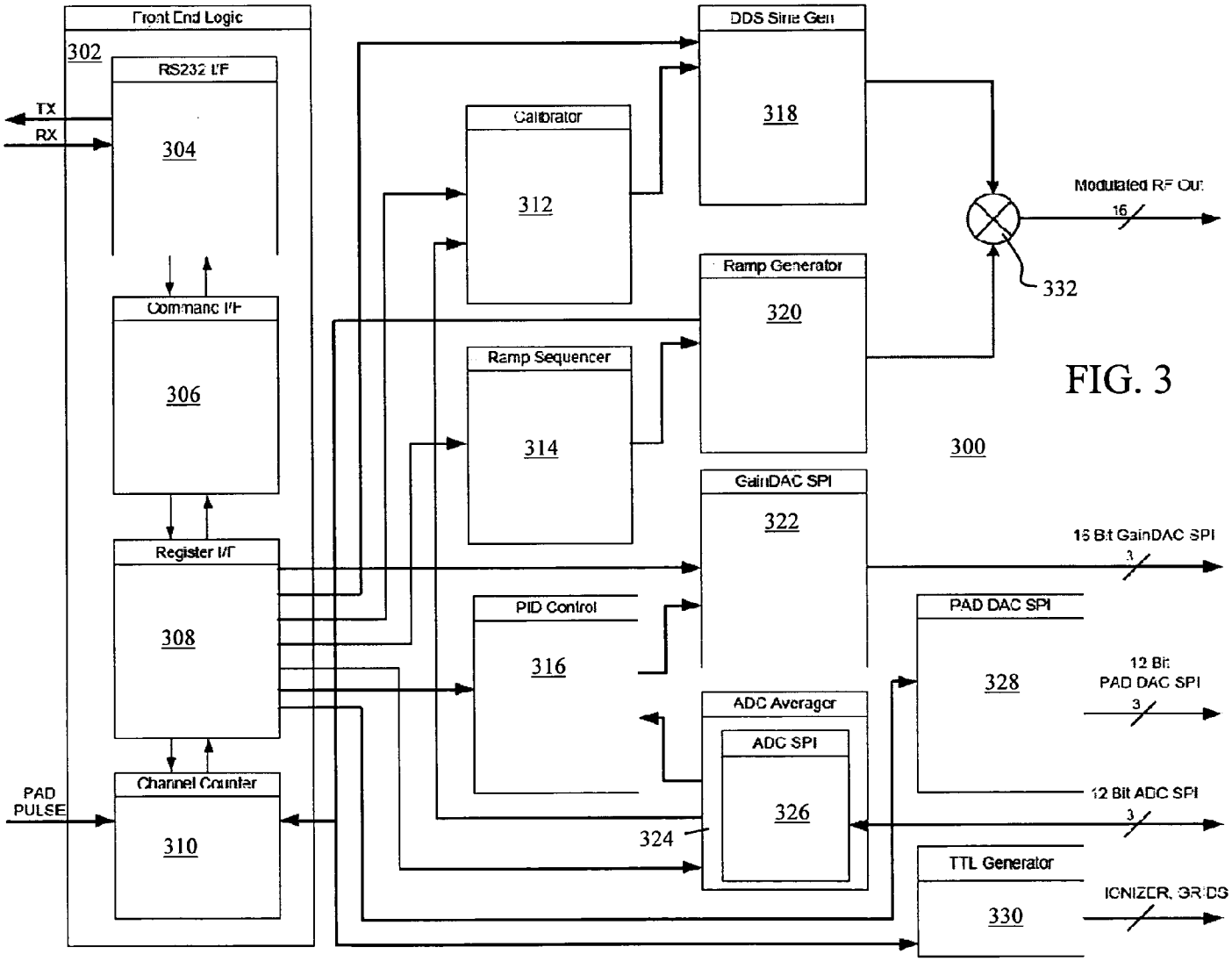
FIG. 3 is an exemplary functional block diagram of the control unit (in the form of an exemplary FPGA) in accordance with the present invention.

FIG. 3 is an exemplary functional block diagram of the control unit (in the form of an exemplary FPGA 202) in accordance with the present invention. As illustrated in FIG. 3, the FPGA 202 includes a front-end logic 302, having a serial interface in the form of an exemplary RS232 that allows for communication from the FPGA 202 to a host computing device (not shown). The front-end logic 202 of the FPGA 202 further includes a command interface 306 that processes serial commands, and a register interface 308 for register setting and management. Further included with the front-end logic 302 is a channel counter 310 for counting pulses from a pre-amplifier and discriminator unit 266 (FIG. 2) and continuously double buffering into a Random Access Memory (RAM) (not shown) an accumulated mass spectrum. It should be noted that the RAM can be embedded. The accumulation of an acquired mass spectrum is performed in a multi-channel scaling mode where successive time bins are summed in a correct location, with double buffering required so that real time counting continues while transmission of a previous frame is carried out. For example, after one second of accumulation nominally 50 ramps, partitioned in to exemplary 4096 time bins, the channels (accumulated mass spectrum) are transmitted back.

As further illustrated in FIG. 3, the FPGA 202 further includes a Direct Digital Synthesis (DDS) sine generator module 318 for generating a fixed amplitude digital sine wave (within the FPGA), which is then digitally modulated with a ramp envelope signal 230 (FIG. 2) through the use of an embedded multiplier 332. Further included within the FPGA 202 is a calibrator module 312 for determining an optimum operational frequency for the drive current, with is enacted when initiated and functions prior to each operational run. According to the present invention, the optimum operational frequency is at the resonant frequency of the inductive element 234 and the capacitance represented by the mass spectrometer 240. In general, the resonant frequency is determined by sequentially sweeping, and iteratively halving an initial upper and lower bound frequency instantiated by a feedback unit (described below) into a granularity of finer resolution frequency. Each iterative frequency sweep includes a span that is one-half a span of a previous sweep with the upper and lower bound frequency one-half spectrum as a previous sweep. A center point of each subsequent frequency sweep is located where a peak signal from the feedback unit was found. In final iterative stages of calibration, as a resonant peak is located, the calibrator module is switched into a Q-mode where a sweep is performed to determine several consistent maximum peak values found. The center frequency (the resonant frequency) is returned by finding symmetrical deviations from the peak value, and finding the mid-point of the deviations.

As further illustrated in FIG. 3, the FPGA 202 additionally includes a ramp sequencer 314 for generating a correct number of ramps, and providing any required delays by a time period between the generated ramps. The ramp sequencer 314 is tracks how many ramps to generate and the timing of the inter-ramp delays. As further illustrated, the output of the ramp sequencer 314 is coupled with a ramp generator 320 (part of FPGA 202) for generating linear ramp outputs of a particular slope and initial and final amplitude, forming an envelope signal 230 (FIG. 2), which is determined based on a mass range scanned by the mass spectrometer.

As illustrated in FIG. 3, the FPGA 202 also includes a Gain Digital to Analog Converter Serial Peripheral Interface (Gain DAC SPI) module that receives an exemplary 16 bit digital value that sets a scale factor for a mass range scanned that is used by a Gain Digital to Analog Converter (Gain DAC) 118 (FIG. 1), which is describe in detail below. Additionally, the FPGA 202 includes a Proportional Integral Derivative (PID) control module 316 for amplitude stabilization of a high voltage RF output 203 on a ramp to ramp basis, which captures a set point from the ADC Averager 324 at the peak of the first ramp. This value becomes representative of a small-integrated value of a decaying time constant (due to an averaging capacitor) at the top of the ramp. The digital averaging also filters the signal. In another embodiment, a specific DSP filtering block could be used herein. The set point is recorded on the first ramp peak, (nominally after 20 ms of operation). On each subsequent peak a new ADC value is recorded. The difference between this new value and the set point allows an error (err) value to be computed. The error is then scaled by a proportional constant Kp. The error is also compared to previous error and this delta including its direction is multiplied by a differential constant Kd and from this a corrective GainDac value is computed by summing (Kp*err_i)+(Kd*[err_i−err_i−1]), where "*" is multiplication, with the old GainDac Value. This new value is written out to the GainDAC between each ramp and drives the output back in a direction such that the ADC setpoint will be recovered. The integrating term is incorporated by the actual change in the GainDAC value and this inherently gives the control system a notion of "memory." In another embodiment this could be scaled by Ki, which is an integral constant.

As further illustrated in FIG. 3, the FPGA 202 includes an Analog to Digital Converter Serial Peripheral Interface (ADC SPI) module 326 for communication with an external Analog to Digital Converter (ADC) 206 (FIG. 2). It should be noted that the output of the ADC SPI 326 is the representation of the envelope of the output 203, and the closed loop control of the present invention is closed on this value, which means that this value must accurately reflect (or represent) output 203. As also illustrated in FIG. 3, the FPGA 202 further includes an Analog to Digital Converter Averager (ADC Avg) module 324 that acquires $2^n$ samples from the ADC SPI module and averages them, with n determined by a register setting.

The FPGA 202 further includes a Pulse Amplitude Discriminator Digital to Analog Converter Serial Peripheral Interface (PAD DAC SPI) module 328, which sets the PAD DAC, which sets the threshold 272 for the PAD 268 (the pre-amp). As further illustrated, FPGA 202 includes a Transistor Transistor Logic (TTL) generator module 330 that generates pulses that are synchronous to certain portions of each ramp such that high voltage pulsing circuitry (external to the electronics) can be driven to create proper ionization, grid, and lens voltages on instrument. The location and duty cycle of these pulses are determined by register settings in the FPGA 202.

The FPGA registers provide the flexibility to modify the slope, proportions and absolute scale of the defining ramp envelope. This allows full control over the Low Mass Cutoff (LMCO), the RF voltage ramp slope dV/dt, and the spectrometer mass range (which is adjustable within any interval of 1-400 AMU or greater). Additionally, the FPGA registers provide settings for ramp duty cycle, the period and amplitude of the electron-impact ionizer, grid and lens TTL signals, threshold settings for the Pre-Amplifier and Detector (PAD) at the output of the channel type electron multiplier or microchannel plate, and multi-channel mass accumulation. The PID coefficients and ADC filtering capabilities are also defined by registers. The ability to reprogram the SRAM based FPGA as the hardware is in situ has proven extremely useful in laboratory settings and gives one board the versatility to be used in a variety of configurations from flight projects to specialized isotope measurement setups with varying interface electronics.

In addition, the FPGA 202 uses its embedded block RAM to store the mass spectrum in a multi-channel scaling mode, in real time as the charge pulses are detected by the board. These "mass spec frames," the duration of which is programmable, can be streamed back to a host PC over an exemplary 115,200 bps serial connection at user defined intervals. As a full hardware based solution, timing of the ionizations and grid pulses and the accumulation of the channel data with respect to the ramp generation is fully synchronized to the FPGA system clock.

Figure 4:
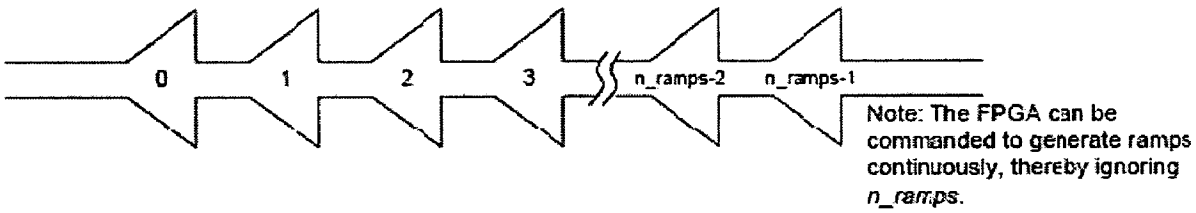
FIG. 4 is an exemplary diagram of a basic an RF Ramp in accordance with the present invention.
Figure 4:
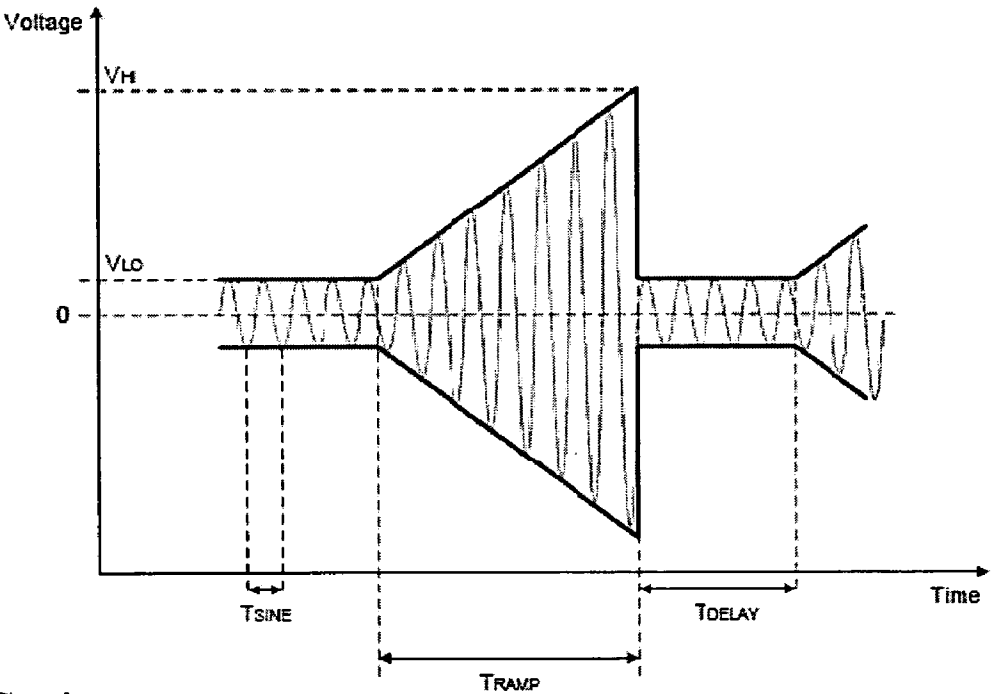

The modules that are used to generate an RF Ramp are defined above. FIG. 4 shows the basic RF ramp. A sine wave with a frequency $T_{SINE}$ is multiplied by a periodic ramp signal with high and low voltage values specified by $V_{HI}$ and $V_{LO}$ respectively. The duration of the ramp is specified by TRAMP and the delay between ramps is called $T_{DELAY}$.

Referring back to FIG. 2, the driving waveform 203 is digitally synthesized in the FPGA 202 clocked at an exemplary value of approximately 100 MHz, with the modulation of a programmable envelope on a resonant carrier frequency (nominally approximately 500 kHz) is performed with embedded multipliers resident in the FPGA 202. The digitally synthesized ramped sine wave is delivered over a parallel Low Voltage Differential Signaling (LVDS) bus 204 to a high speed waveform Digital to Analog Converter (DAC) 106 clocked at 50 MHz. The DAC 206 is clocked inverted from the data delivered by the FPGA 202 for preventing data converter glitches. The DAC 206 is coupled with the FPGA 202 for converting the digital signal to an analog signal. The DAC 206 utilizes a current-steering architecture and generates a differential current output that is buffered by the differential buffer 210, converted to a voltage, and the voltage signal is then sent to an Analog Multiplying Cell (AMC) 214, which is coupled with the DAC 206 and Gain DAC 218 for scaling a final output signal amplitude based on a desired mass scanning range. The differential buffer 210 is coupled with a differential current output DAC 206 for continuously receiving and generating a continuous voltage signal.

As illustrated in FIG. 2, in this embodiment the AMC 214 is comprised of a VGA, with the VGA coupled with a Gain Digital to Analog Converter (Gain DAC) 218, with the digital value of the Gain DAC representing a direct current (DC) voltage of a predetermined value set with a voltage reference $V_{REF}$ 220 coupled with the Gain DAC 218 for providing fixed, stable voltage reference, which is precise over temperature variations. The gain of this VGA 214 is programmed by the output of the Gain DAC 218 that is set by a user programmable exemplary 16 bit register via the Gain DAC Serial Peripheral Interface (SPI) module 322 of the FPGA 202, providing dynamic mass range. In particular, the Gain DAC 218 provides overall dynamic range i.e., doubling its output value will double the mass range being scanned, and when the Proportional Integral Differential (PID) module 316 is activated (in normal operation) the Gain DAC 218 is used to stabilize the final output in full closed loop control.

As further illustrated in FIG. 2, a Radio Frequency Power Amplifier (RF PA) 226 is coupled with the AMC 214 via bus 224 for driving the final output signal. The RF PA 226 is comprised of one or more high speed amplifiers coupled in parallel topography for driving the final output signal, which is a high current output drive signal. The high current output drive signal is then routed through an exemplary 50 ohm coax cable to a box that houses the inductive components 234 of a high Q series resonant tank. This tank acts as both a highly effective bandpass filter and a final gain stage, with the capacitive reactance provided by the Paul ion trap itself (the load) 240. In other words, the inductive element 234 are coupled with the RF PA and the mass spectrometer 240 for amplification of the final output signal at a resonant frequency of the inductive element 234 and a capacitance presented by the mass spectrometer 240. Therefore, RF PA functions to drive sufficient current necessary to drive the resonant LC tank. The current generated and applied to the LC tank at a resonant frequency provides a very high amplification voltage to the mass spectrometer. At the resonant frequency, the inductive reactance of the inductors 234 and the capacitive reactance of the mass spectrometer 240 cancel each other to provide a high voltage gain at resonant. Accordingly, the inductor-capacitor combinations are precisely activated at a resonant frequency, which is determined by the FPGA 202 via an exemplary calibration scheme described above.

As illustrated, the inductive elements 234 are comprised of a number of inductors coupled in series, with the series coupled inductors 234 coupled with the mass spectrometer 240 in a series resonant configuration. The number of inductors and core material selected is such that AC flux density is limited to a linear regime of the core material's permeability deviations. Non-limiting example of the core material used is an iron powdered mix with distributed air gap. The core geometry and winding configuration is selected to operate at an optimal point on an inherent Q curve for the selected core geometry and winding configuration, which minimizes losses to reduce power consumption, increase quality factor and sharpness of bandpass filter created by the series resonant (the inductor/spectrometer coupling) configuration.

The data converters, gain stage, and the amplifier stages are all selected for linearity and reduced noise specifications. However, the magnetics used to provide the inductive leg of the series tank are the main contributors to non-linearity in the transfer function of the circuit. While an air core inductor would be ideal, the size and shielding requirements become prohibitive for lightweight terrestrial or space instrumentation. Mechanisms of non-linearity must be considered when selecting a core material. These include changes in permeability as a function of peak AC flux density (B), changes in permeability as a function of magnetizing force (H), and core loss and changes in permeability over temperature. These can be mitigated by selecting a low permeability stable core material such as iron powder and distributing the AC flux density over several cores to keep operating areas in the highly linear portions (<200 Gauss) of the material's B verses permeability curve. The iron powder (carbonyl) core selected has a distributed air gap mixed in with the material. By keeping the peak AC flux density of the core in a range that exhibits linearity, the present invention ensure the permeability non-linearities will only occur due to temperature. These slow changing non-linearities are thwarted with closed loop control. The present invention uses five miniature-shielded inductors 234 that include a shielded pot core made by the manufacturer Micrometals, which are iron powder cores, a specific non-limiting example of which is carbonyl—Mix 2. In addition, the core material is operated in an area near its own inherent 'Q-curve' that minimizes losses. This reduces power consumption and increases the quality factor (or sharpness) of the bandpass filter that is created in the series resonant architecture. The same design requirements for core material selected would need to be considered in transformer based implementation, and if not, would result in a ramp with some non-linear properties. The use of a series resonant tank provides an extremely sharp bandpass filter at the operational frequency, provided the operational frequency is at the resonant frequency. This sharpness is only limited by the quality factor of the inductors themselves that is determined by the Q-Curve of a particular core, in a particular winding configuration. Operating at a frequency that exhibits high Q passes the drive frequency but attenuates all other out of band noise such as high frequency clocks on the board and external EMI.

Of course, temperature changes (with respect to non-linearities of the inductors) must be addressed as even the "low tempco" materials are only 95 ppm stability, which would result in significant "mass smearing" or mass broadening if severe changes in temperature are encountered. Mass smearing (or mass broadening) occurs because the change in permeability results in decreased inductance that changes the resonant frequency of the filter. The drive frequency however remains the same, hence the amplification (due to Q) is now different so the criterion for ion ejection (from the Mathieau equation) is met later in time, the spectrum smeared over several channels, and mass resolution is decreased. The control of the voltage-amplitude is via a PID control loop 316 built into the FPGA 202. The loop clamps a set point utilizing the RMS to DC converter 250 (which has an external time-averaging capacitor selected to provide effective envelope detection). Additional digital filtering is performed on the ADC 256 samples. Any deviance from the initial set point is measured as an error and a corrective action is taken by adjusting the VGA 214 gain setting via the Gain DAC 218.

It should be noted that the magnetic board 232 housing the inductors 234 is typically connected to the flange of the mass spectrometer. Of course, the magnetic board 232 can be an integral part of the mixed signal RF drive electronics board 200, forming a single unitary piece. However, removing the magnetics to a separate, flange-mounted box provides three critical advantages. First, the high voltage electronics are removed from the mixed signal drive board 200 and localized to one small shielded box. This mitigates the need to follow high voltage design principles on the more complex drive board and places the final stage of the drive directly adjacent to the load. Second, driving a coaxial cable with onboard magnetics presents the problem of additional coaxial cable load capacitance. This additional capacitance is detrimental to Q (which decreases filtering capability and increases power consumption) because the added capacitance reduces the resonant frequency and would unnecessarily move the operating frequency off of the associated Q-curve of the inductor's core material as published in the iron powder material datasheets. This additional capacitance is also detrimental to the circuit Q, resulting in a decreased filtering capability and increased power consumption. Third, with the distributed magnetics one has the ability to utilize the same drive board with various magnetic boxes to change fundamental operating frequency in order to, for example, change the desired tapping or filtering mass range of the mass spectrometer 240. Of course, the mixed signal RF drive electronics board 200, the magnetics board or box 232, and the PAD unit 266 may be integrated on a single PCB.

As further illustrated in FIG. 2, the present invention provides a closed loop feedback unit coupled with the FPGA 202 for continuous fine-tuning of the final output drive signal for accommodating environmental variation and system non-linearities. The feedback unit is comprised of an exemplary pair of resistors R that form a divider circuit 236 that provides an RF sense signal at 244 that is a divided version of a high voltage output 203, which is fed back to the mixed signal RF drive electronics board 200. The feedback unit is further comprised of a Field Effect Transistor (FET) input buffer 246 that receives the RF sense signal, and outputs the results to a Root-Mean-Square to Direct Converter (RMS-DC) 250, which is sampled by an Analog to Digital Converter 256 for use of the FPGA 202 for automatic detection of the resonant RF prior to instrument operation and closed loop RF amplitude control, if Proportional Integral Differential (PID) mode is enabled.

The high stability (in this instance, 2 ppm/° C. ratio temperature coefficient (tempco) resistor divider 236 yields the RF sense signal, which is fed back to the mixed signal RF drive electronics board 200 through a Polytetrafluoroethylene (PTFE) dielectric coax cable 242, through the FET input buffer 246, to the RMS to DC converter, the output of which is digitally sampled through the exemplary 12-bit Analog to Digital Converter (ADC) 256. Initial detection of the resonant frequency is performed using a state machine that performs successive sweeps of increasing granularity, with the bounds programmed by user defined registers. This enables different boards to run at various frequencies simply by integrating a slightly modified remote magnetics box.

The calibration module 312 of the FPGA 202 specifically finds the resonant frequency without the use of any manually tunable components. This means that any changes in trap capacitance or tank inductance that might have occurred due to any environmental or mechanical variations is compensated for prior to each run, and handled completely in hardware. The calibration module 312 also indicates if any broken or shorted connections have arisen inside the instrument itself, i.e., a disconnected wire due to extreme vibration would be detected and an appropriate register flag set within the FPGA 202. The self-tuning also allows various configurations of tank inductance to be used, without any changes to the mixed signal RF drive electronics board 200. For example, different tank inductances can be switched on or off electronically to vary the operational frequency in an exemplary range of 1 MHz to 2 MHz. Accordingly, no manual tuning is required.

The presence of an RMS-DC converter within the closed look feedback unit of the present invention performs envelope detection and utilizes an averaging capacitor to determine envelope's time constant. The present invention scales non-linearities with amplitude. Accordingly, by determining envelope deviations on a ramp to ramp basis a PID (Proportional, Integral, Derivative) block 316 in the FPGA 202 accommodates for the changes by changing the overall system gain on a ramp to ramp basis. Of course, faster ADCs could be used and ramp updates to the envelope could be made in real time as the ramp is being generated. This is not necessary in the present implementation to achieve the desired linearity, mass resolution and stability over temperature. However, faster ADCs could be used to compensate for less desirable ramp non-linearities that could arise from slightly different core materials in the magnetics, less optimum operational frequencies (i.e., being off-Q) or a poorer selection of integrated circuits (references, data converters or amplifiers).

Additionally, of primary concern in a closed feedback unit control system is the quality of the measurement circuitry that reflects the output voltage the feedback is to measure. With an impedance divider one needs the impedance ratio to track with temperature. Specifically, as the environment heats up the measurement resistors will change differently than the dielectric of the printed circuit board. The present invention uses an impedance divider in the measurement circuit that will be the lower resistor of the divider in parallel with the capacitance of the cable 238. The present invention uses a low tempco Teflon dielectric along with 2 ppm resistor divider. This maintains the raw measurement within an error budget, with that node buffered by a FET input buffer 246, which ensures that the measurement will not be corrupted. The output of the FET input buffer 246 is fed to the RMS to DC converter 250 that uses a stable dielectric averaging capacitor 252. The ADC's reference has a low tempco as well.

The Pre-PAD board 266 is an exemplary embodiment of a well-known charge sensitive preamplifier and discriminator combined with a line driver 270 and threshold setting 274. The charge sensitive pre-amp 268 senses the charge pulses and an appropriate TTL pulse is forwarded to the FPGA 202 through line 276. Low noise printed circuit board layout is imperative to the operation of the PAD board 266. The threshold level for PAD DAC 274 is set via line 284.

The present invention also provides an acquisition unit for acquiring and collecting mass spectral data from mass spectrometer. As hardware based solution, the present invention eliminates software from the data acquisition that guarantees that the charge pulses, which in turn become the mass spectrum, are explicitly accumulated in the proper "time bin." The FPGA 202, being a piece of hardware simultaneously generates ramps and accumulates the mass spectrum as the modules are constantly clocked. Mass spectral "frames" that are sent back to a host PC for analysis are guaranteed to have occurred at a specific location in time with respect to the synthesized ramp.

The mixed signal RF drive electronics board 200 is comprised of a minimum of eight layers (depending on generation), and incorporates a partitioned ground plane for analog and digital portions tied at one central system ground point near the converters. LVDS traces are controlled impedance, the pairs are matched in length, and trace-to-trace spacing rules are followed according to the LVDS standard. Copper is removed near the input leads of amplifiers to minimize parasitic capacitance. Liberal use of ferrite beads and bypass capacitors are used throughout the board.

The power regulator portion of the block diagram was left out of the architectural diagram for simplicity. However, in the effort to miniaturize the electronics and consume less power, efficient converters were used. The net power is less than 10 W in full scale ramping mode. Only one switching supply was used to avoid coupled switching noise where possible.

Figure 5:
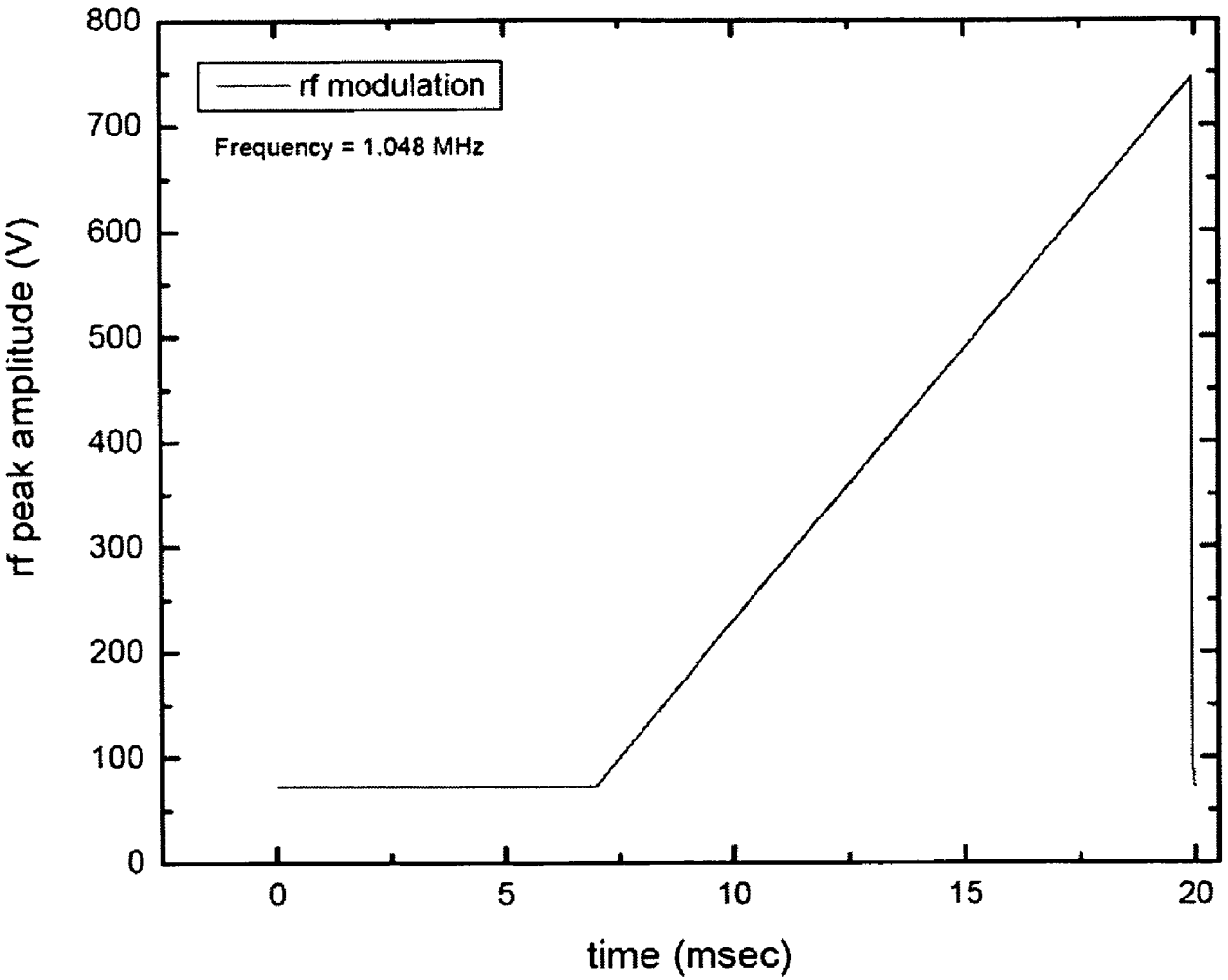
FIG. 5 is an exemplary illustration of linearity of the high voltage RF peak amplitude generated by the practice of the present invention.
Figure 6:
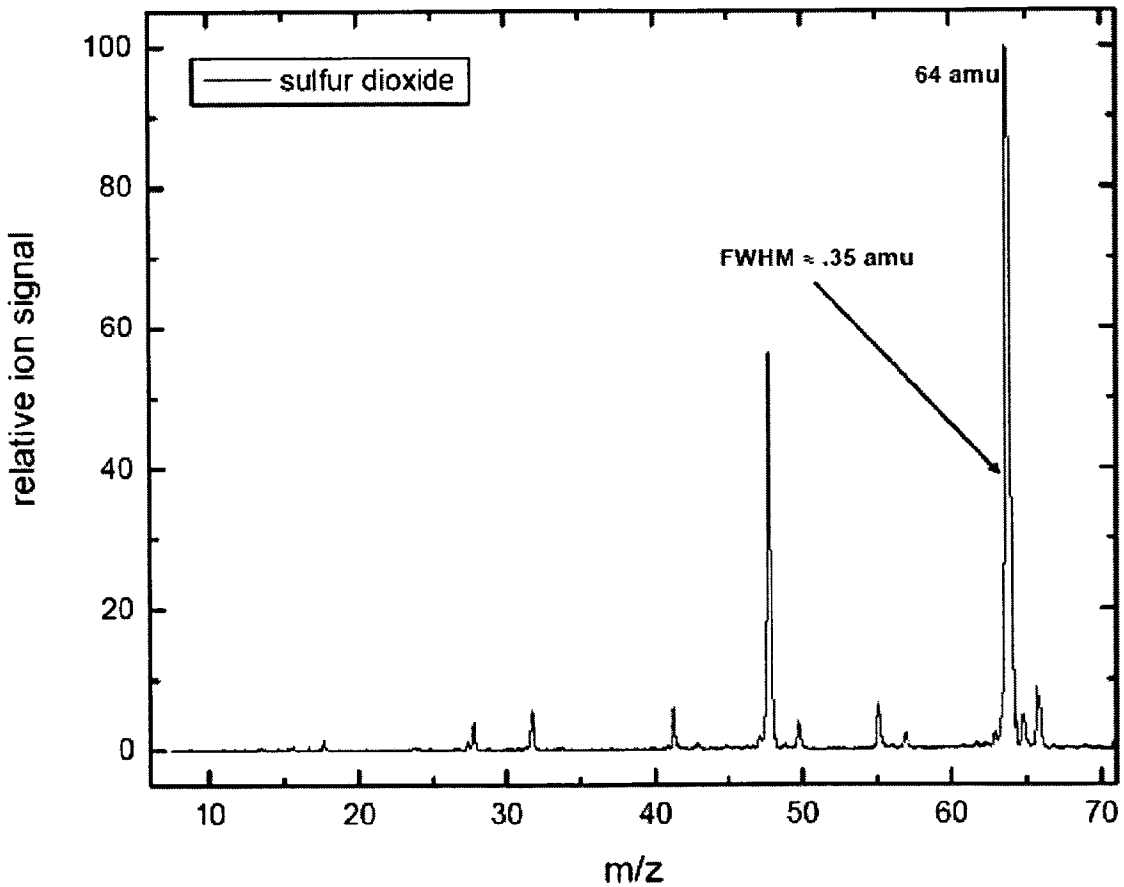
FIG. 6 is an exemplary illustration of a mass spectrum demonstrating the mass resolution generated by the practice of the present invention.

FIG. 5 illustrates the inherent linearity of the high voltage RF peak amplitude 103 generated by the practice of the present invention. Mass ejection occurs in the same linear manner as dictated by the Mathieau equation. FIG. 6 illustrates a mass spectrum demonstrating the mass resolution generated by the practice of the present invention. As illustrated, the SO2 peak at 64 amu has a FWHM peak width of 0.35 amu yielding a mass resolution $M/\Delta M$ of 64/0.35, which is greater than 182, or a factor of 4.5 better the prior-art demonstrated $M/\Delta M$ of 40.9, more than.

Although the invention has been described in considerable detail in language specific to structural features and or method acts, it is to be understood that the invention defined in the appended claims is not necessarily limited to the specific features or acts described. Rather, the specific features and acts are disclosed as preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. For example, a non-limiting example of an Analog Multiplying Cell may include a Variable Gain Amplifier (VGA), analog multipliers, or discrete transistor multiplication stages. Instead of using a DAC 106 with a differential current output, a DAC may be used instead that directly generates a single analog voltage, which is directly input to a VGA. Such variations and alternate embodiments are contemplated, and can be made without departing from the spirit and scope of the invention.

It should further be noted that throughout the entire description, the labels such as left, right, front, back, top, bottom, forward, reverse, clockwise, counter clockwise, up, down, or other similar terms such as upper, lower, aft, fore, vertical, horizontal, proximal, distal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) is not used to show a serial or numerical limitation but instead is used to distinguish or identify the various members of the group.

In addition, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of," "act of," "operation of," or "operational act of" in the claims herein is not intended to invoke the provisions of 35 U.S.C. 112, Paragraph 6.

Please note that the U.S. Pat. No. 7,161,142 to Patterson et al. is included as an appendix to the present document herein.

What is claimed is:

1. An electronic drive system for signal generation, comprising:

a mixed signal RF drive electronics board having:

a control unit for generating a digital signal used for driving a mass spectrometer;

a Digital to Analog Converter (DAC) coupled with the control unit for converting the digital signal to an analog signal;

an Analog Multiplying Cell (AMC) coupled with the DAC for scaling a final output signal amplitude based on a desired mass scanning range;

a Radio Frequency Power Amplifier (RF PA) coupled with the AMC for driving the final output signal;

an inductive element coupled with the RF PA and the mass spectrometer for amplification of the final output signal at a resonant frequency of the inductive element and a capacitance presented by the mass spectrometer;

a closed loop feedback unit coupled with the control unit for continuous fine-tuning of the final output signal for accommodating environmental variation and system non-linearities; and an acquisition unit as part of the control unit for acquiring and collecting mass spectral data from mass spectrometer;

wherein the control unit comprises a Field Programmable Gate Array (FPGA); and wherein: the FPGA includes front end logic, including: a serial interface that allows for communication from the FPGA to a host computing device; a command interface that receives and processes serial commands; a register interface for register setting and management; and a channel counter for counting pulses from a pre-amplifier and discriminator unit and continuously double buffering into a Random Access Memory (RAM) an accumulated mass spectrum; wherein the serial, command, and register interfaces and the channel counter are all in communicate with one another.

2. The electronic drive system for signal generation as set forth in claim 1, wherein: the accumulated mass spectrum is amassed in a multi-channel scaling mode where successive time bins are summed in a correct location, with double buffering required so that real time counting continues while transmission of a previous frame is carried out.

3. An electronic drive system for signal generation, comprising:

a mixed signal RF drive electronics board having:

a control unit for generating a digital signal used for driving a mass spectrometer;

a Digital to Analog Converter (DAC) coupled with the control unit for converting the digital signal to an analog signal;

an Analog Multiplying Cell (AMC) coupled with the DAC for scaling a final output signal amplitude based on a desired mass scanning range;

a Radio Frequency Power Amplifier (RF PA) coupled with the AMC for driving the final output signal;

an inductive element coupled with the RF PA and the mass spectrometer for amplification of the final output signal at a resonant frequency of the inductive element and a capacitance presented by the mass spectrometer;

a closed loop feedback unit coupled with the control unit for continuous fine-tuning of the final output signal for accommodating environmental variation and system non-linearities; and an acquisition unit as part of the control unit for acquiring and collecting mass spectral data from mass spectrometer;

wherein the control unit comprises a Field Programmable Gate Array (FPGA); and wherein: the FPGA includes a Direct Digital Synthesis (DDS) sine generator module for generating a fixed amplitude digital sine wave.

4. The electronic drive system for signal generation as set forth in claim 3, further including: an embedded multiplier that digitally modulates the fixed amplitude digital sine wave with a ramp envelope signal.

5. An electronic drive system for signal generation, comprising:

a mixed signal RF drive electronics board having:

a control unit for generating a digital signal used for driving a mass spectrometer;

a Digital to Analog Converter (DAC) coupled with the control unit for converting the digital signal to an analog signal;

an Analog Multiplying Cell (AMC) coupled with the DAC for scaling a final output signal amplitude based on a desired mass scanning range;

a Radio Frequency Power Amplifier (RF PA) coupled with the AMC for driving the final output signal;

an inductive element coupled with the RF PA and the mass spectrometer for amplification of the final output signal at a resonant frequency of the inductive element and a capacitance presented by the mass spectrometer;

a closed loop feedback unit coupled with the control unit for continuous fine-tuning of the final output signal for accommodating environmental variation and system non-linearities; and an acquisition unit as part of the control unit for acquiring and collecting mass spectral data from mass spectrometer;

wherein the control unit comprises a Field Programmable Gate Array (FPGA); and wherein the FPGA includes a calibrator module for determining an optimum operational frequency for the drive current; and wherein the optimum operational frequency is at the resonant frequency of the inductive element and the capacitance represented by the mass spectrometer.

6. The electronic drive system for signal generation as set forth in claim 5, wherein: the resonant frequency is determined by sequentially sweeping, and iteratively reducing an initial upper and lower bound frequency instantiated by the feedback unit into a granularity of finer resolution frequency, with each iterative frequency sweep having a span that is less than a span of a previous sweep; a center of each subsequent frequency sweep is located where a peak signal from the feedback unit was found, and in a final iterative stages of calibration, as a resonant peak is located, the calibrator module is switched into a Q-mode where a sweep is performed to determine several consistent peak values found; and a single center frequency is returned by finding symmetrical deviations from the peak value and finding the mid-point of the deviations.

7. An electronic drive system for signal generation, comprising:

a mixed signal RF drive electronics board having:

a control unit for generating a digital signal used for driving a mass spectrometer;

a Digital to Analog Converter (DAC) coupled with the control unit for converting the digital signal to an analog signal;

an Analog Multiplying Cell (AMC) coupled with the DAC for scaling a final output signal amplitude based on a desired mass scanning range;

a Radio Frequency Power Amplifier (RF PA) coupled with the AMC for driving the final output signal;

an inductive element coupled with the RF PA and the mass spectrometer for amplification of the final output signal at a resonant frequency of the inductive element and a capacitance presented by the mass spectrometer;

a closed loop feedback unit coupled with the control unit for continuous fine-tuning of the final output signal for accommodating environmental variation and system non-linearities; and an acquisition unit as part of the control unit for acquiring and collecting mass spectral data from mass spectrometer;

wherein the control unit comprises a Field Programmable Gate Array (FPGA); and wherein the FPGA includes a ramp sequencer for generating a correct number of ramps, and provide any required delays by a time period between generated ramps.

8. The electronic drive system for signal generation as set forth in claim 7, wherein: the FPGA ramp sequencer further functions to place the FPGA in a continuous operational mode.

9. An electronic drive system for signal generation, comprising:

a mixed signal RF drive electronics board having:

a control unit for generating a digital signal used for driving a mass spectrometer;

a Digital to Analog Converter (DAC) coupled with the control unit for converting the digital signal to an analog signal;

an Analog Multiplying Cell (AMC) coupled with the DAC for scaling a final output signal amplitude based on a desired mass scanning range;

a Radio Frequency Power Amplifier (RF PA) coupled with the AMC for driving the final output signal;

an inductive element coupled with the RF PA and the mass spectrometer for amplification of the final output signal at a resonant frequency of the inductive element and a capacitance presented by the mass spectrometer;

a closed loop feedback unit coupled with the control unit for continuous fine-tuning of the final output signal for accommodating environmental variation and system non-linearities; and an acquisition unit as part of the control unit for acquiring and collecting mass spectral data from mass spectrometer;

wherein the control unit comprises a Field Programmable Gate Array (FPGA); and wherein the FPGA includes a ramp generator for generating linear ramp outputs of a particular slope and initial and final amplitude, forming an envelope signal, which is determined based on a mass range scanned.

10. An electronic drive system for signal generation, comprising:

a mixed signal RF drive electronics board having:

a control unit for generating a digital signal used for driving a mass spectrometer;

a Digital to Analog Converter (DAC) coupled with the control unit for converting the digital signal to an analog signal;

an Analog Multiplying Cell (AMC) coupled with the DAC for scaling a final output signal amplitude based on a desired mass scanning range;

a Radio Frequency Power Amplifier (RF PA) coupled with the AMC for driving the final output signal;

an inductive element coupled with the RF PA and the mass spectrometer for amplification of the final output signal at a resonant frequency of the inductive element and a capacitance presented by the mass spectrometer;

a closed loop feedback unit coupled with the control unit for continuous fine-tuning of the final output signal for accommodating environmental variation and system non-linearities; and an acquisition unit as art of the control unit for acquiring and collectin mass spectral data from mass spectrometer;

wherein the control unit comprises a Field Programmable Gate Array (FPGA); and wherein the FPGA includes a Gain Digital to Analog Converter Serial Peripheral Interface (Gain DAC SPI) module that receives a digital value that sets a scale factor for a mass range scanned that is used by a Gain Digital to Analog Converter (Gain DAC).

11. An electronic drive system for signal generation, comprising:

a mixed signal RF drive electronics board having:

a control unit for generating a digital signal used for driving a mass spectrometer;

a Digital to Analog Converter (DAC) coupled with the control unit for converting the digital signal to an analog signal;

an Analog Multiplying Cell (AMC) coupled with the DAC for scaling a final output signal amplitude based on a desired mass scanning range;

a Radio Frequency Power Amplifier (RF PA) coupled with the AMC for driving the final output signal;

an inductive element coupled with the RF PA and the mass spectrometer for amplification of the final output signal at a resonant frequency of the inductive element and a capacitance presented by the mass spectrometer;

a closed loop feedback unit coupled with the control unit for continuous fine-tuning of the final output signal for accommodating environmental variation and system non-linearities; and an acquisition unit as part of the control unit for acquiring and collecting mass spectral data from mass spectrometer;

wherein the control unit comprises a Field Programmable Gate Array (FPGA); and wherein the FPGA includes a Proportional Integral Derivative (PID) control module for amplitude stabilization of a high voltage RF output on a ramp to ramp basis.

12. An electronic drive system for signal generation, comprising:

a mixed signal RF drive electronics board having:

a control unit for generating a digital signal used for driving a mass spectrometer;

a Digital to Analog Converter (DAC) coupled with the control unit for converting the digital signal to an analog signal;

an Analog Multiplying Cell (AMC) coupled with the DAC for scaling a final output signal amplitude based on a desired mass scanning range;

a Radio Frequency Power Amplifier (RF PA) coupled with the AMC for driving the final output signal;

an inductive element coupled with the RF PA and the mass spectrometer for amplification of the final output signal at a resonant frequency of the inductive element and a capacitance presented by the mass spectrometer;

a closed loop feedback unit coupled with the control unit for continuous fine-tuning of the final output signal for accommodating environmental variation and system non-linearities; and an acquisition unit as part of the control unit for acquiring and collecting mass spectral data from mass spectrometer;

wherein the control unit comprises a Field Programmable Gate Array (FPGA); and wherein the FPGA includes an Analog to Digital Converter Serial Peripheral Interface (ADC SPI) module for communication with an external Analog to Digital Converter (ADC).

13. The electronic drive system for signal generation as set forth in claim 12, wherein: the FPGA includes an Analog to Digital Converter Averager (ADC Avg) that acquires 2.sup.n samples from the ADC SPI module and averages them; with n determined by a register setting.

14. An electronic drive system for signal generation, comprising:

a mixed signal RF drive electronics board having:

a control unit for generating a digital signal used for driving a mass spectrometer;

a Digital to Analog Converter (DAC) coupled with the control unit for converting the digital signal to an analog signal;

an Analog Multiplying Cell (AMC) coupled with the DAC for scaling a final output signal amplitude based on a desired mass scanning range;

a Radio Frequency Power Amplifier (RF PA) coupled with the AMC for driving the final output signal;

an inductive element coupled with the RF PA and the mass spectrometer for amplification of the final output signal at a resonant frequency of the inductive element and a capacitance presented by the mass spectrometer;

a closed loop feedback unit coupled with the control unit for continuous fine-tuning of the final output signal for accommodating environmental variation and system non-linearities; and an acquisition unit as part of the control unit for acquiring and collecting mass spectral data from mass spectrometer;

wherein the control unit comprises a Field Programmable Gate Array (FPGA); and wherein the FPGA includes a Pulse Amplitude Discriminator Digital to Analog Converter Serial Peripheral Interface (PAD DAC SPI) for setting the PAD DAC, which sets a threshold for the PAD.

15. An electronic drive system for signal generation, comprising:

a mixed signal RF drive electronics board having:

a control unit for generating a digital signal used for driving a mass spectrometer;

a Digital to Analog Converter (DAC) coupled with the control unit for converting the digital signal to an analog signal;

an Analog Multiplying Cell (AMC) coupled with the DAC for scaling a final output signal amplitude based on a desired mass scanning range;

a Radio Frequency Power Amplifier (RF PA) coupled with the AMC for driving the final output signal;

an inductive element coupled with the RF PA and the mass spectrometer for amplification of the final output signal at a resonant frequency of the inductive element and a capacitance presented by the mass spectrometer;

a closed loop feedback unit coupled with the control unit for continuous fine-tuning of the final output signal for accommodating environmental variation and system non-linearities; and an acquisition unit as part of the control unit for acquiring and collecting mass spectral data from mass spectrometer;

wherein the control unit comprises a Field Programmable Gate Array (FPGA); and wherein the FPGA includes a Transistor Transistor Longic (TTL) generator module that generates pulses that are synchronous to certain portions of each ramp such that high voltage pulsing circuitry can be driven to create proper ionization, grid and lens voltages on instrument.

16. An electronic drive system for signal generation, comprising:

a mixed signal RF drive electronics board having:

a control unit for generating a digital signal used for driving a mass spectrometer;

a Digital to Analog Converter (DAC) coupled with the control unit for converting the digital signal to an analog signal;

an Analog Multiplying Cell (AMC) coupled with the DAC for scaling a final output signal amplitude based on a desired mass scanning range;

a Radio Frequency Power Amplifier (RF PA) coupled with the AMC for driving the final output signal;

an inductive element coupled with the RF PA and the mass spectrometer for amplification of the final output signal at a resonant frequency of the inductive element and a capacitance presented by the mass spectrometer;

a closed loop feedback unit coupled with the control unit for continuous fine-tuning of the final output signal for accommodating environmental variation and system non-linearities; and an acquisition unit as part of the control unit for acquiring and collecting mass spectral data from mass spectrometer; and wherein the AMC is comprised of a VGA, with the VGA coupled with a Gain Digital to Analog Converter (Gain DAC), with the digital value of the Gain DAC representing a direct current (DC) voltage of a predetermined value set with a voltage reference VREF coupled with the Gain DAC for providing fixed, stable voltage reference.

17. An electronic drive system for signal generation, comprising:

a mixed signal RF drive electronics board having:

a control unit for generating a digital signal used for driving a mass spectrometer;

a Digital to Analog Converter (DAC) coupled with the control unit for converting the digital signal to an analog signal;

an Analog Multiplying Cell (AMC) coupled with the DAC for scaling a final output signal amplitude based on a desired mass scanning range;

a Radio Frequency Power Amplifier (RF PA) coupled with the AMC for driving the final output signal;

an inductive element coupled with the RF PA and the mass spectrometer for amplification of the final output signal at a resonant frequency of the inductive element and a capacitance presented by the mass spectrometer;

a closed loop feedback unit coupled with the control unit for continuous fine-tuning of the final output signal for accommodating environmental variation and system non-linearities; and an acquisition unit as part of the control unit for acquiring and collecting mass spectral data from mass spectrometer;

wherein the inductive element is comprised of a plurality of inductors coupled in series made of a core material;

wherein the core material is comprised of an iron powdered mix with distributed air gap; and wherein the plurality of inductors are remotely coupled with the RF PA, and are coupled with a flange of a mass spectrometer on a board.

* * * * *